United States Patent [19]

Elkowitz

[11] Patent Number: 4,804,946

[45] Date of Patent: Feb. 14, 1989

[54] PRE-WIRED WINDOW PANE

[76] Inventor: Andrew I. Elkowitz, 28 Lighthouse Rd., Great Neck, N.Y. 11024

[21] Appl. No.: 847,663

[22] Filed: Apr. 3, 1986

[51] Int. Cl.[4] ..... G08B 13/02

[52] U.S. Cl. ..... 340/550; 219/543

[58] Field of Search ..... 340/550, 541, 545, 590; 200/61.62, 61.84; 116/86; 52/171; 219/203, 522, 543, 547

[56] References Cited

U.S. PATENT DOCUMENTS

| | | | |
|---|---|---|---|
| 3,041,436 | 6/1962 | Brady | 219/203 |
| 3,356,833 | 12/1967 | Orcutt | 219/203 X |
| 3,634,845 | 1/1972 | Colman | 340/550 |
| 3,909,331 | 9/1975 | Cohen | 340/550 |
| 3,947,837 | 3/1976 | Bitterice | 200/61.84 X |
| 4,227,766 | 10/1980 | Finale | 340/550 |
| 4,228,425 | 10/1980 | Cooke | 340/550 |
| 4,234,875 | 11/1980 | Williams | 340/550 |
| 4,350,978 | 9/1982 | Riccobono | 340/550 |
| 4,367,460 | 1/1983 | Hodara | 340/550 |

FOREIGN PATENT DOCUMENTS

| | | | |
|---|---|---|---|
| 2412432 | 9/1975 | Fed. Rep. of Germany | 340/550 |
| 2844018 | 4/1980 | Fed. Rep. of Germany | 340/550 |
| 3003683 | 8/1981 | Fed. Rep. of Germany | 340/550 |
| 2169426 | 7/1986 | United Kingdom | 340/550 |

*Primary Examiner*—Joseph A. Orsino
*Assistant Examiner*—Brian R. Tumm
*Attorney, Agent, or Firm*—Richard L. Miller

[57] ABSTRACT

A pre-wired window is provided and consists of a set of window panes mounted in a frame, one window pane is conventional, the other is pre-wired on the inside surface with an extremely thin soft electrically conductive wire which allows unobstructed vision through the window. The wire is connected to conventional terminals on a conventional terminal block mounted on the outer surface of the pre-wired window panel. An alternative system uses an electrolytic gel in place of the wire, however wire is used to make the connection to the terminal from the gel. The resulting system is a pre-wired high thermal efficienty double panel window ready to be connected to generally available burglar alarm system at the terminals.

10 Claims, 1 Drawing Sheet

PRE-WIRED WINDOW PANE

BACKGROUND OF THE INVENTION

This invention relates to intrusion sensors, and more particularly to pre-wired window panes.

Intrusion devices using mechanical devices activated by the unauthorised opening of doors and windows were the first to be employed. Electrically activated devices replaced the mechanical as the field matured. Currently external metallic tape attached to the external window periphery and varnished for protection from damage is widely used. Furthermore, U. S. Pat. No. 4,228,425 granted Oct. 14, 1980 to William C. Cooke shows a laminated structure carrying conductive elements in a special glass and plastic laminate thus limiting its general application and adding cost. A system employing wires in parallel elongated panel is used to detect unauthorized breach of walls and other structure is shown in U.S. Pat. No. 4,234,875 granted Nov. 18, 1980 to William H. Williams. A fiber optic sensor embedded in a transparent panel is shown in U.S. Pat. No. 4,376,460 granted Jan. 4, 1983 to Henri Hodara. These systems can cause obstruction of view through the window pane and require a regular pattern of wires which could allow easy removal of portions of the window.

A need exists for a transparent conductive pre-wired window arrangement which is generally available, economical and resistant to damage.

SUMMARY OF THE INVENTION

It is therefore an object of this invention to provide a new and improved window pane.

It is another object of this invention to provide a new and improved pre-wired window pane.

It is yet another object of this invention to provide a new and improved pre-wired window pane using thin wire.

It is still another object of this invention to provide a new and improved window pane of double pane construction.

It is yet further object of this invention to provide a new and improved pre-wired window pane using electrolytic gel.

It is yet still another object of this invention to provide a new and improved pre-wired window pane with unobstructed view.

It is still further object of this invention to provide a new and improved pre-wired window pane with minimal chance of damage to the system.

Further objects of the invention will appear as the description proceeds.

To the accomplishment of the above and related objects, this invention may be embodied in the form illustrated in the accompanying drawings, attention being called to the fact, however, that the drawings are illustrative only and that changes may be made in the specific construction illustrated and described within the scope of the appended claims.

BRIEF DESCRIPTION OF THE DRAWING FIGURES

The figures in the drawings are briefly described as follows.

DESCRIPTION OF THE PREFERRED EMBODIMENT

Figure 1:
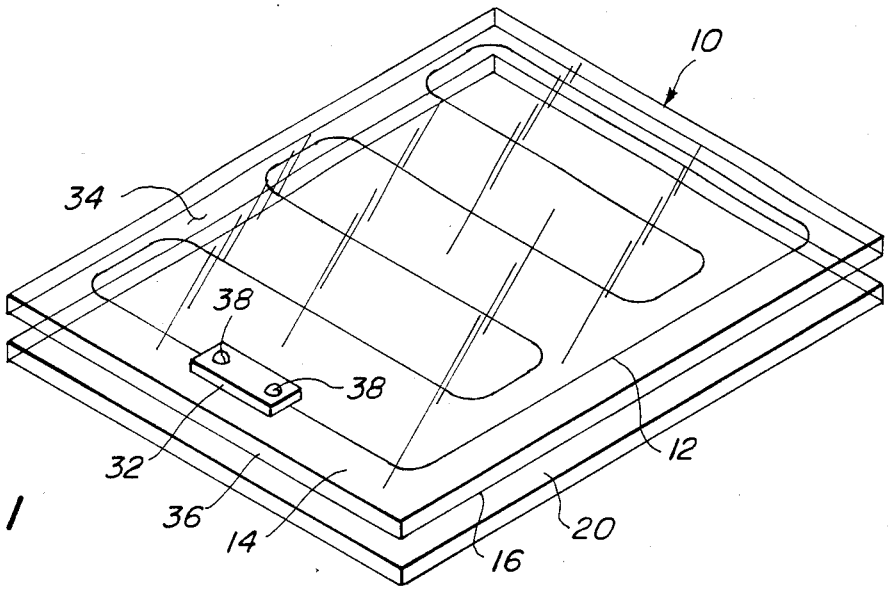
FIG. 1 is a perspective view of the invention with the frame omitted for clarity.

FIG. 1 shows a pre-wired window pane 10 consisting of a conductive wire 12 and a transparent window pane 14. Wire 12 is a soft metal wire material disposed in a regular or irregular pattern on an inside surface 16 of pane 14 and has a thin predetermined diametral size. Affixing wire 12 to inside surface 16 of pane 14 is accomplished using a transparent adhesive 18 (FIGS. 2 and 4) between the wire 12 and inside surface 16 of pane 14. A pane 20 is disposed at a predetermined distance parallel to pre-wired pane 10. A frame 22 has four sides with predetermined width and length, each perpendicular to the other, and forms a rectangle. A pair of slots 24 are milled or otherwise formed in a conventional way in an internal surface 26 of each side of frame 22 at a predetermined heights which are the same for each of the four sides of frame 22. Slots 24 are continuous along the internal perimeter of frame 22 and are of predetermined height and depth to coact with pane 14 and pane 20 when used in conjunction with a glazing material 28. Assembly of pre-wired pane 10, pane 20 and frame 22 is accomplished by first placing glazing material 28 on all surfaces of slots 24 of three inside sides of frame 22; positioning pre-wired pane 10 and pane 20 into slots 24 and next attaching the fourth side with glazing material 28 by nailing, glueing, stapling or the like. A space 30 between pre-wired pane 14 and pane 20 is thus established.

Figure 2:
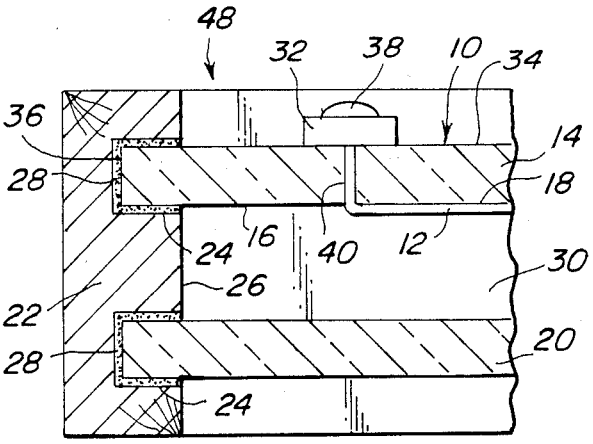
FIG. 2 is a cross sectional view taken through the terminal block in FIG. 1 showing the thin wire on the inner surface of one of the panes.
Figure 3:
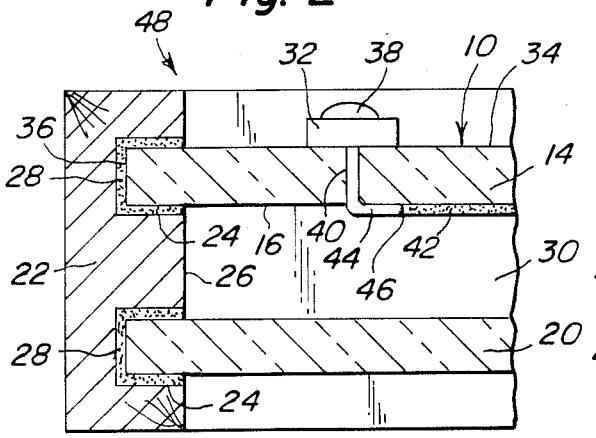
FIG. 3 is a similar view illustrating an electrolytic gel in place of the thin wire.

A termination block 32 is attached to outer surface 34 of pane 14 at a predetermined location proximate an edge 36 thereof. Attachment of block 32 is achieved by glueing, bolting or the like. Wire 12 is affixed to termination block 32 at a set of terminals 38 the method used for affixing terminal 38 to block 32 may be soldering, crimping or other conventional methods. Wire 12 is routed to terminal 38 through a set of holes 40 in the pane 14 (FIGS. 2 and 3). Holes 40 are disposed perpendicular to the plain of pane 14 proximate the block 32. The wires can be sealed air tight in the holes with glazing compound or other types of sealant material well known in the art, or alternately wires can be pre-embeded through the pane during the original manufacture of the pane.

Figure 4:
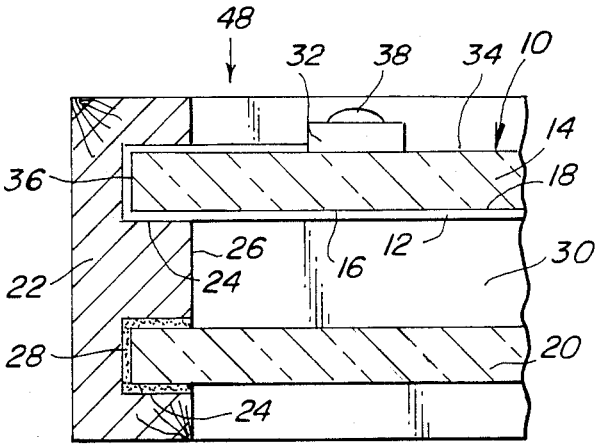
FIG. 4 is a cross sectional view taken through the terminal block in FIG. 2 showing an alternative method of connecting the thin wire to the terminal block.
Figure 5:
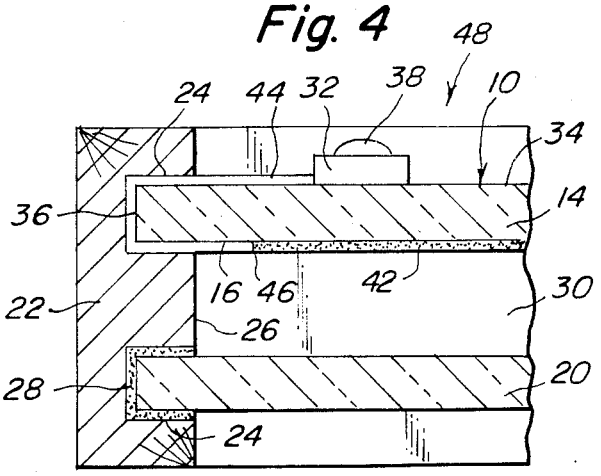
FIG. 5 is similar to the view of FIG. 4 illustrating the alternative connection method in conjunction with an electrolytic gel.

Another alternate method of routing the wire 12 to terminals 38 is shown in FIGS. 4 and 5, wire 12 is continued to an edge 36 of pane 14 bent 90° at the intersection of edge 36 and inside surface 16 wire 12 continued with edge 36 wire 12 is bent 90° at the intersection of edge 36 and outer surface 34 and terminated at terminals 38.

Alternatively an electrolyte gel 42 is disposed in similar manner as that described for wire 12, on pane 14. Electrical connection of gel 42 to terminals 38 is executed by joining a termination wire 44 (FIGS. 3 and 5)

at a junction 46. Termination wire 44 is connected by the same techniques described for wire 12.

The construction herein described produces a high thermal efficiency double pane window 48 in the general form of a right parallelepiped, with a first rectangular surface pre-wired pane 10 and a second rectangular surface pane 20 contained in frame 22.

It is to be obviously understood that while the panes illustrated are rectangular in shape naturally the same construction could be applied to any shape window panes, and also that the space between the panes may be filled with a dry gas and partially evacuated etcetera as well known in the art to increase thermal efficiency.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A pre-wired window, comprising, a transparent window pane of a predetermined size and thickness generally of any configuration; a conductive wire of soft metal disposed on a first surface of said transparent window pane having a diametral size such as not to obstruct vision through said transparent window pane; a termination block mounted on a second surface opposite said first surface and proximate to an edge of said transparent window pane; and means for terminating said wire whereby said wire is affixed to the termination block, and further including a second transparent window pane, essentially the same size and thickness as said transparent window pane, mounted in a frame, said frame being essentially parallelepiped with a first pair of sides of essentially equal length and a second pair of sides of essentially equal length, wherein all four sides are of essentially equal height and depth, each said sides having a pair of slots disposed parallel to each other on the inner surface of said side at a predetermined distance from each other, a first slot of said pair of slots is disposed a predesigned distance from a first edge of said side and a second predetermined distance from a second edge of said side, wherein said second edge is perpendicular to said first edge, wherein said first edge and said second edge are outside surfaces of said side; said slots being disposed in each of four said sides, a glazing material applied to all surfaces of said slots; the resultant assembly forming a high thermal efficiency double pane window.

2. The pre-wired window of claim 1, wherein connection of said wire to said termination block is made by wrapping said wire around the edge of said transparent window pane said edge proximate to said termination block and continuing to deploy said wire in a direction perpendicular to said edge and in the direction of said termination block.

3. The pre-wired window of claim 1, wherein connection of said wire to said terminal is made by means for routing said wire through said transparent window pane proximate said termination block.

4. The pre-wired window of claim 3, wherein means for routing said wire through said transparent window pane is accomplished by passing said wire through a set of holes of predetermined size, wherein said holes are perpendicular and pass through the first and second surfaces of said transparent window pane.

5. The pre-wired window of claim 3, wherein means for routing said wire through said transparent window pane is accomplished by embedding said wire through said window pane during the manufacture of said pane.

6. A pre-wired window, comprising, a transparent pane of predetermined size and thickness generally of any configuration; an electrolytic gel, said gel being transparent, disposed on said first surface of said transparent window pane, a conductive wire of soft metal and diametral size such as not to obstruct vision forming an electrical junction with said gel, a termination block mounted on a second surface opposite said first surface, and proximate to an edge of said transparent window pane; and means for terminating said wire whereby said wire is affixed to the termination block, and further including a second transparent window pane, essentially the same rectangular size and thickness as said transparent window pane, mounted in a frame, said frame being essentially parallelepiped with a first pair of sides of essentially equal length and a second pair of sides of essentially equal length, wherein all four sides are of essentially equal height and depth, each said sides having a pair of slots disposed parallel to each other on the inner surface of said side at a predetermined distance from each other, a first slot of said pair of slots is disposed a predesigned distance from a first edge of said side and a second predetermined distance from a second edge of said side, wherein said second edge is perpendicular to said first edge, wherein said first edge and said second edge are outside surfaces of said side; said slots being disposed in each of said four sides, glazing material to all surfaces of said slots; the resultant assembly forming a high thermal efficiency double pane window.

7. The pre-wired window of claim 6, wherein connection of said wire to said termination block is made by wrapping said wire around the edge of said transparent window pane said edge proximate to said termination block and continuing to deploy said wire in a direction perpendicular to said edge and in the direction of said termination block.

8. The pre-wired window of claim 6, wherein connection of said wire to said terminal is made by means for routing said wire through said transparent window pane proximate said termination block.

9. The pre-wired window of claim 8, wherein means for routing said wire through said transparent window pane is accomplished by embedding said wire through said window pane during the manufacture of said pane.

10. The pre-wired window of claim 8, wherein means for routing said wire through said transparent window pane is accomplished by passing said wire through a set of holes of predetermined size, wherein said holes are perpendicular and pass through the first and second surfaces of said transparent window pane.

* * * * *